US005229182A

United States Patent [19]

Eisman et al.

[11] Patent Number: 5,229,182

[45] Date of Patent: Jul. 20, 1993

[54] CUP CONSTRUCTION

[75] Inventors: Larry Eisman, Elkins Park; Gina Polsin; Frank Sabo, both of Coatesville, all of Pa.

[73] Assignee: Dopaco, Inc., Downingtown, Pa.

[21] Appl. No.: 815,955

[22] Filed: Jan. 2, 1992

[51] Int. Cl.[5] ..... B32B 3/02

[52] U.S. Cl. ..... 428/80; 428/542.8; 428/34.2; 229/1.5 B; 229/4.5; 229/DIG. 9

[58] Field of Search ..... 428/80, 542.8, 34.2; 229/1.5 B, 4.5, DIG. 9

[56] References Cited

U.S. PATENT DOCUMENTS

| | | | |
|---|---|---|---|
| 1,025,659 | 5/1912 | Vargyas | 229/1.5 B |
| 1,692,951 | 11/1928 | Pinckney | 229/1.5 B |
| 1,940,406 | 12/1933 | Ericson | 229/1.5 B |
| 4,171,085 | 10/1979 | Doty | 229/1.5 B |

FOREIGN PATENT DOCUMENTS

| | | | |
|---|---|---|---|
| 958388 | 5/1964 | United Kingdom | 229/1.5 B |

*Primary Examiner*—Ellis P. Robinson
*Assistant Examiner*—Nasser Ahmad
*Attorney, Agent, or Firm*—Dennison, Meserole, Pollack & Scheiner

[57] ABSTRACT

A cup blank including opposed arced longitudinal outer and inner edges formed on common radii. The outer edge, at opposed ends thereof, includes linear extents. Linear extents may also be provided at the opposed end portions of the inner longitudinal edge. The common radii and linear edge extents enable a cut line layout of multiple blanks wherein transversely adjacent rows of blanks are defined by a common longitudinal cut line therebetween.

13 Claims, 4 Drawing Sheets

FIG. 3 PRIOR ART
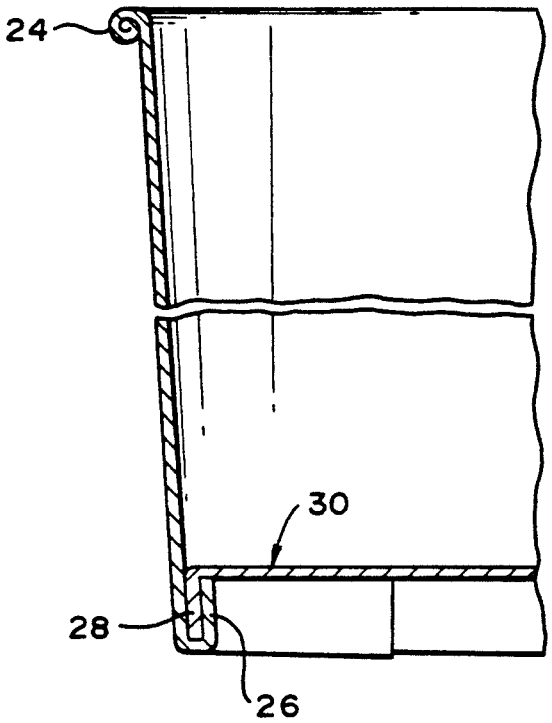
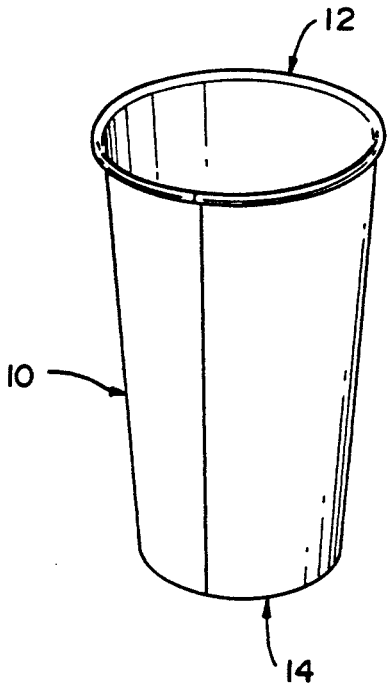
FIG. 1
FIG. 9
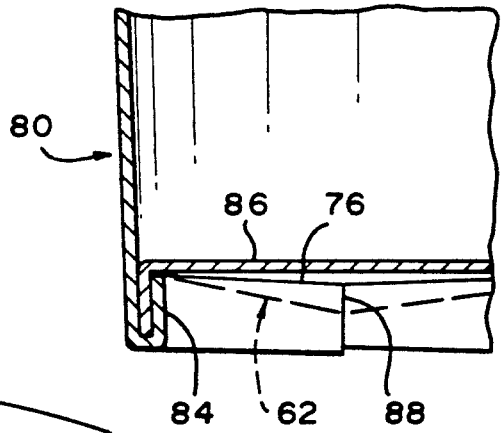
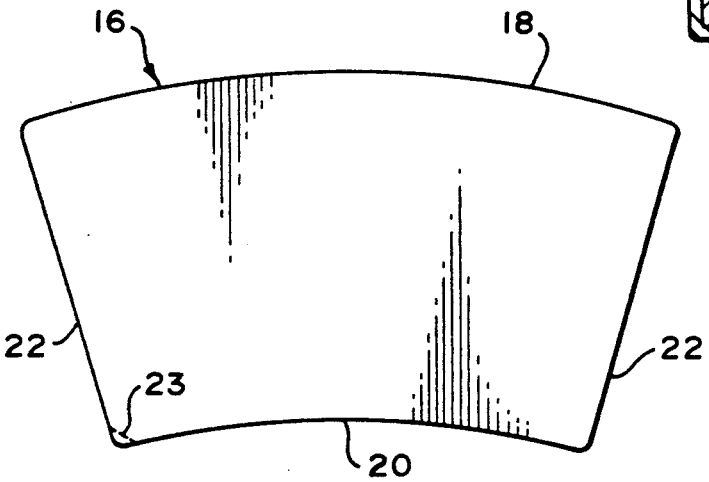
FIG. 2
PRIOR ART FIG. 6
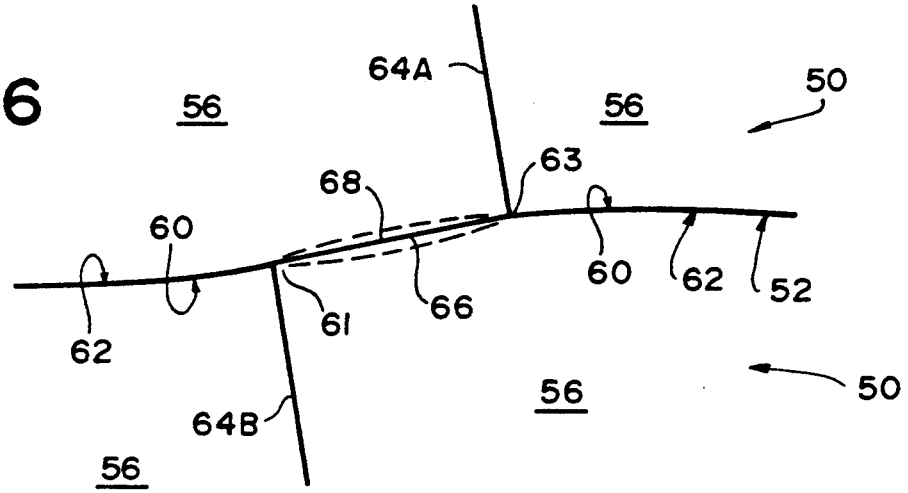
FIG. 7
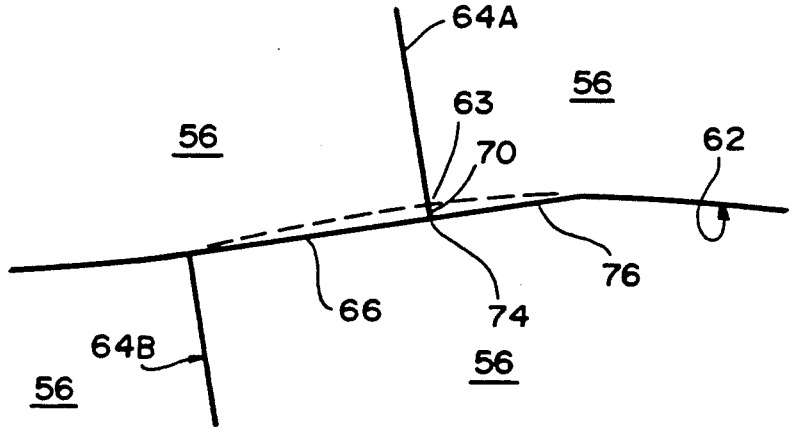
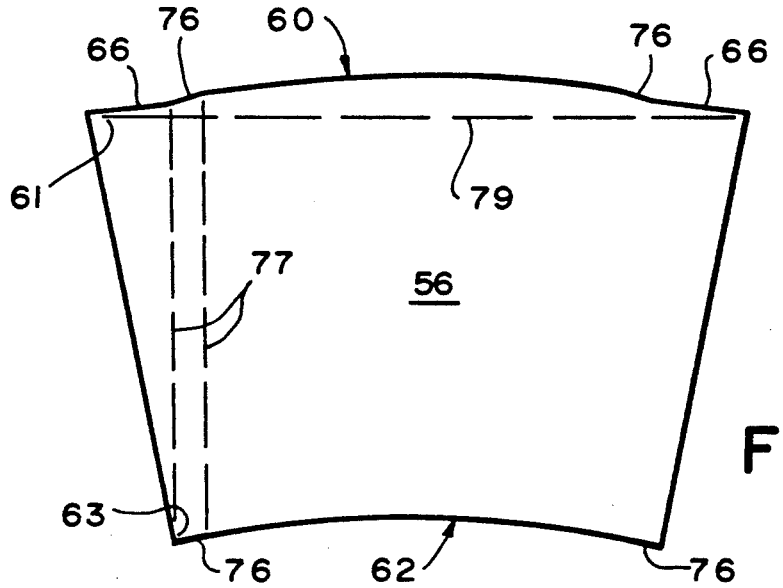
FIG. 8

CUP CONSTRUCTION

BACKGROUND OF THE INVENTION

Paperboard drinking cups and the like are conventionally formed from a blank having opposed longitudinal edges arced to define, upon a rolling of the blank, a circular cup mouth and a relatively smaller circular cup base with the cup body tapering therebetween. The arcs of the opposed longitudinal edges are formed on different radii in accord with the diameter of the cup at the mouth and base. As such, the radius of the arc of the base edge is conventionally appreciably less than the radius of the arc of the mouth edge. For example, in one form of standard 32 ounce cup, the radius for the mouth edge will be 24.9611 inches while the radius for the base edge will be 17.207 inches.

In forming the cup from the blank, the mouth edge will be outwardly rolled to define a lip. The base edge will be inwardly folded and appropriately crimped and bonded to a bottom panel, and usually to a depending peripheral flange thereon. The conventional blank incorporates more than sufficient material to accommodate the edge forming.

In actually producing the blanks, paperboard is supplied from a roll with lengths thereof cut by knife blades, for example in the form of die plates, roller dies, or the like, to simultaneously define a continuous series of blanks in adjacent longitudinal rows.

The blanks in each row are alternately inverted with the opposed longitudinal edges thereof defined by a separate pair of sinuous cut lines each alternately defining a convex mouth edge and a concave base edge of differing radii. The longitudinally aligned adjacent blanks in each line are defined by transverse edge cuts inclined to extend between the longitudinal lines at approximately the transition point between adjacent convex and concave lengths.

The blanks in adjacent rows are transversely aligned across the width of the length or sheet of paperboard with each row defined by two distinct longitudinal cut lines and with the adjacent cut lines of adjacent rows spaced from each other to accommodate the alternate arcs of different radii. As will be appreciated, this spacing, for example on the order of ¼ inch, produces substantial scrap which is not only in itself expensive but also gives rise to problems in the retrieval and disposal of the scraps.

It will also be recognized that the space necessitated between adjacent rows requires immediately adjacent substantially duplicate cutting blades or assemblies between each adjacent pair of rows. This in turn substantially affects the cost of the equipment, the speed at which the equipment can be run, maintenance problems, and the like.

While it is known to use blanks for short wide ice cream containers with outer mouth and inner base edges formed on common or duplicate radii, such blanks, if cut from sheets as above described, would still require spacing between adjacent rows to accommodate the opposed arcs of the outer edges of adjacent blanks in adjacent rows as shall be explained subsequently.

SUMMARY OF THE INVENTION

The present invention, in producing a cup which is substantially indistinguishable from the standard or conventional cup in capacity, strength and appearance, provides for appreciable economies in materials, production equipment and production procedures.

Such advantages are derived from a blank and layout of blank cut lines wherein multiple cup blanks are formed, each with the major central portion of the outer mouth edge and inner bottom edge on equal or duplicate radii, and with linear or straight line extents extending longitudinally from the opposed ends of the central portion of the outer edge. So configured, the immediately adjacent blanks and strips or rows of blanks to be cut from a sheet can be defined by a single cut line therebetween without requiring dual knives, without waste or scrap, and without the production problems associated with the removal or retrieval of the waste generated in the conventional procedures.

Formed in this manner, not only is the intermediate scrap between rows of formed blank eliminated, but also the overall area of a running length or sheet of the material to produce an equal number of cup blanks is substantially reduced.

Additional features, objects and advantages of the invention are considered to reside in the details of construction and manner of production as more fully hereinafter described and claimed.

BRIEF DESCRIPTION OF THE DRAWINGS

FIG. 1 is a perspective view of a drinking cup of the type herein involved;

FIG. 2 illustrates a blank in accord with the prior art used in the formation of a cup as in FIG. 1;

FIG. 3 is a partial vertical cross sectional view detailing a cup as in FIG. 1 of standard or prior art construction;

FIG. 6 is an enlarged detail of the area in FIG. 5 between four adjacent blanks in two rows;

FIG. 7 is an enlarged detail similar to FIG. 6 illustrating a modification in the longitudinal cut line;

FIG. 8 is a plan view of a single blank in accord with the present invention; and FIG. 9 is a partial vertical cross-sectional view through the lower portion of a cup formed in accord with the present invention.

DESCRIPTION OF THE PREFERRED EMBODIMENTS

Figure 4:
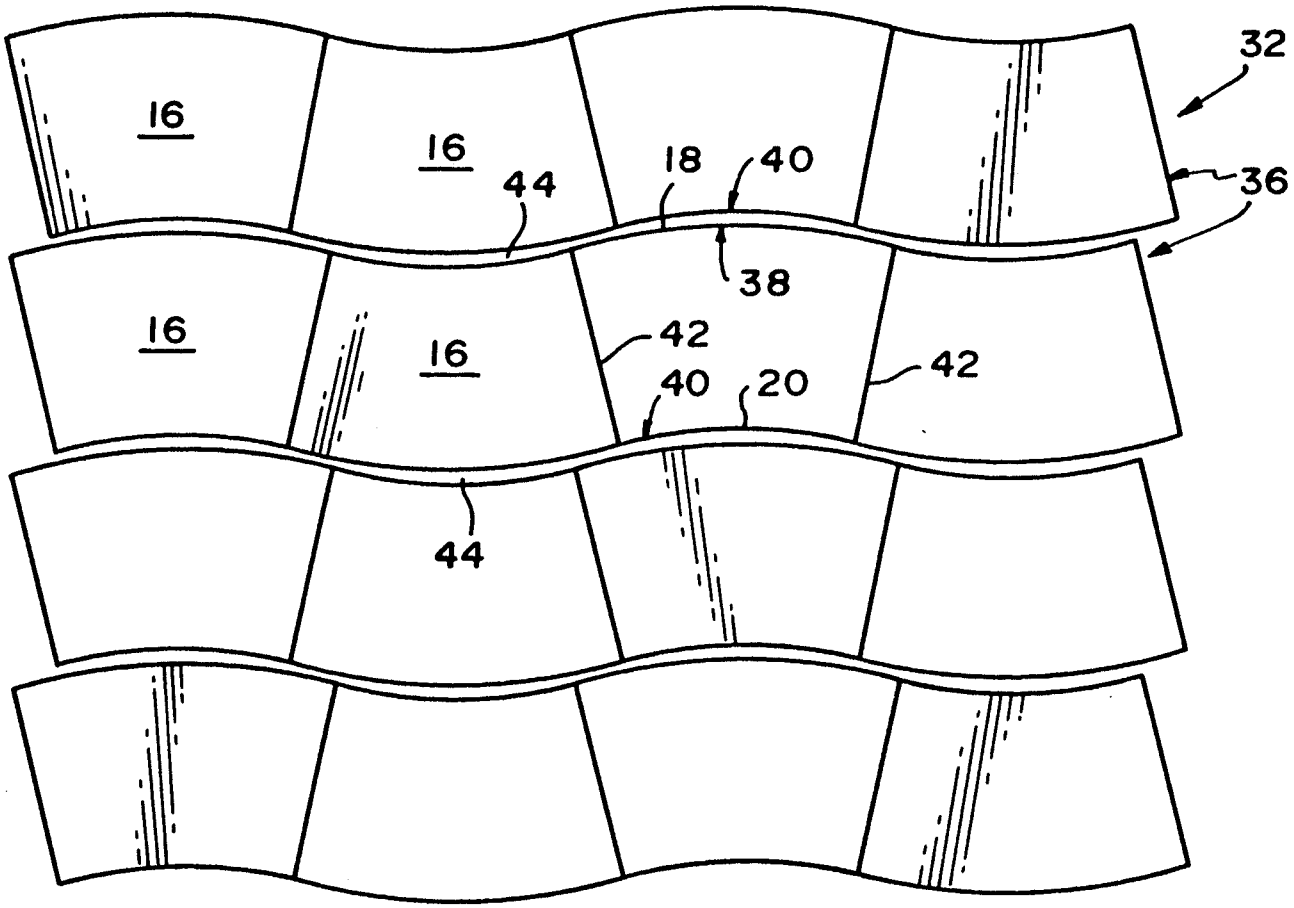
FIG. 4 PRIOR ART
FIG. 4 is a plan view of a length or sheet of material illustrating the layout or pattern for the cutting of multiple blanks in accord with the prior art.
Figure 5:
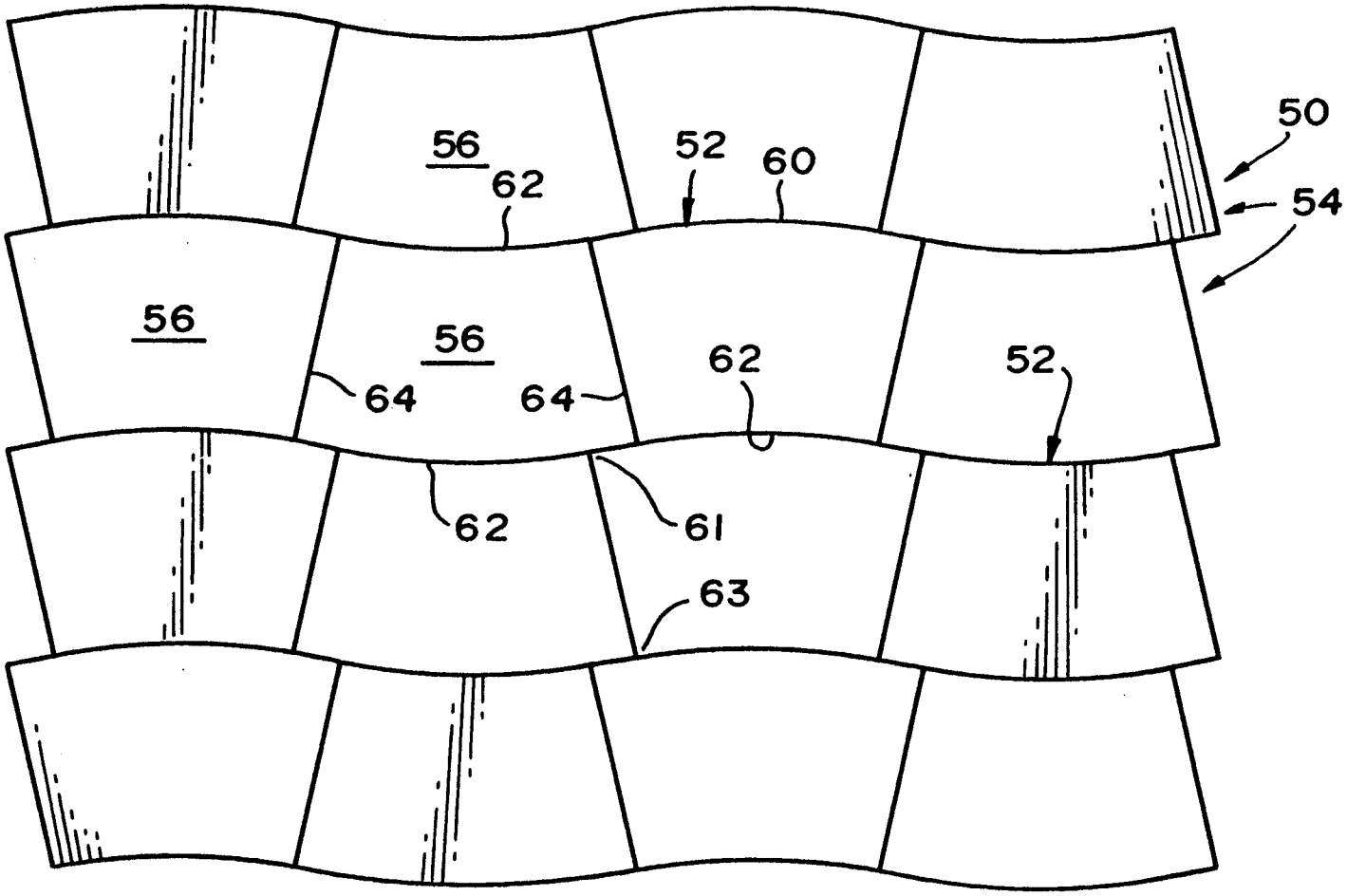
FIG. 5 is a plan view of a length or sheet of material illustrating the pattern or layout for cutting in accord with the present invention.

Referring now more specifically to the drawings, FIG. 1 illustrates a drinking cup 10 of the type with which the present invention is concerned. This cup 10, whether formed in the manner of a standard or conventional cup or formed in accord with the present invention, is of a tall generally inverted frustoconical configuration tapering from an annular wide mouth 12 to a relatively smaller annular base 14.

FIG. 2 illustrates a prior art blank 16 used in the formation of a cup of the type illustrated in FIG. 1. This blank includes arcuate outer and inner longitudinal edges 18 and 20 on different radii in accord with the desired circumference in the completed cup 10. The opposed sides or vertical edges 22 of the blank 16 taper toward each other from the outer longitudinal edge 18 to the relatively shorter inner longitudinal edge 20. As a specific example of a prior art blank, in one standard 16 ounce cup the outer edge 18 will be formed on a radius of 17.524 inches with the radius of the inner longitudinal edge 20 formed on a radius of 12.098 inches. The height of the blank at mid-point is 5.426 inches, and the length of the blank, between the extreme ends or corners of the outer edge 18 is 10.7367 inches. In 32 ounce or larger cups it is also known to remove the lower left corner, as indicated by cut line 23, to avoid excess material in the formed cup. This problem is inherently avoided in the present invention.

The standard blank 16, noting FIG. 3, upon formation into a standard cup 10 has the outer edge 18 thereof outwardly rolled upon itself to define a drinking lip 24. The inner edge 20 is inwardly and upwardly folded on itself, as at 26, about the depending flange 28 of a cup bottom panel 30 and is compressed or crimped and bonded to the inner surface of the blank wall with the bottom panel flange 28 sandwiched therebetween, all in a conventional manner. In the standard or conventional cup, both edges 18 and 20 provide excess material beyond that actually required in the formation of the drinking lip 24 and securement of the bottom panel 30. This excess material facilitates the automated forming of the blanks into the finished cups.

Noting FIG. 4, the standard blanks 16 are cut in panels 32 of several blanks on sheets or lengths of appropriate paperboard material normally fed from large rolls of pre-printed and pre-coated stock. The blanks 16 in the panel 32 are arranged in lateral rows 36 of alternate inverted blanks 16 with the sinuous longitudinal cut lines 38 and 40 of each row alternately defining the convex outer edge of one blank and the concave lesser radius inner edge of the next blank. Transverse cut lines 42 are provided across each row 36 between the sinuous longitudinal edges lines 38 and 40, intersecting each of these lines generally at the transition point between the convex and concave arcs.

Inasmuch as the convex and concave arcs are of different radii, a common cut line cannot be provided between laterally adjacent rows 36. Rather, these rows, as illustrated in FIG. 4, must be laterally spaced from each other, as at 44. While this space 44 can be held to a minimum by laterally aligning the blank layout in adjacent rows, a substantial strip of waste will remain between adjacent rows. This waste is expensive both in the actual material not used in the formation of the blank, and in the retrieval and disposal of the waste. In addition, it will be recognized that dual knife blades, cutters, or the like, are required to define the spaced adjacent edges of the adjacent rows.

Referring now to the invention as illustrated more particularly in FIGS. 5-9, it is the principal purpose of the invention to provide an arcuate cup blank configuration, and pattern or layout 50 wherein only a single longitudinal cut line 52 is required between adjacent rows 54 of transversely aligned blanks 56. In other words, the single longitudinal cut line 52 defines one edge, either the outer edge or inner edge of one blank and simultaneously defines the opposed edge of an immediately adjacent transversely aligned and similarly positioned blank. The savings in materials, cutter equipment, and the like, as well as the economies arising from elimination of scrap and the associated problems of scrap removal and recovery, will be readily recognized.

It is also of particular significance that the improved blank and associated blank layout allow for the formation of a cup 10 which, in general appearance, strength, and capacity, is substantially indistinguishable from cups heretofore formed from conventional or standard blanks.

In order to provide for the single longitudinal cut line 52 between adjacent rows 54 of blanks 56, the outer and inner longitudinal edges 60 and 62 of each blank, for at least the major central portion thereof, are formed on equal or duplicate radii. For example, in a blank for a 16 ounce cup equivalent to the previously described standard 16 ounce cup, the radius of each edge will be on the order of 17.524 inches which, as previously noted, is the radius of the outer edge 18 of a standard cup forming blank. The transverse spacing between the longitudinal cut lines 52 is substantially equal to the transverse spacing between longitudinal cut lines 38 and 40 in the standard layout 32 for the same capacity cup, thus providing blanks which in turn will form drinking cups of equal height and capacity. The defining of the blanks 56 also includes inclined transverse cut lines 64 between each adjacent pair of longitudinal cut lines 52, forming outer and inner corners 61 and 63 respectively at the outer and inner edges 60 and 62.

The spacing of the transverse cut lines 64 at the ends thereof defining an inner longitudinal edge 62, as well as the length of cut lines 64, differ from the transverse cut lines 42 of the standard layout 32 by inconsequential amounts normally on the order of 0.05 inches or less and arise from the use of common radii and modifications to the lines defining the opposed blank edges 60 and 62 as shall be explained subsequently.

However, inasmuch as the common longitudinal cut line 52 defines, for extents thereof adjacent the longitudinal ends of each blank, end portions of the convex outer edges 60 of two adjacent blanks in adjacent rows, the convex form of each line cannot be maintained for each of the commonly formed end extents. As such, containers with common radius inner and outer edges, as the ice cream containers previously referred to in the Background of the Invention, would, if formed in sheets of multiple rows, still require dual cut lines between adjacent rows.

Noting the enlarged detail of FIG. 6 illustrating the junction area between adjacent rows and adjacent blanks therein, the longitudinal cut line 52, between adjacent transverse cut lines 64A and 64B in adjacent upper and lower rows 50, will be formed along a straight line section or linear extent 66 between the lower end of the upper transverse cut line 64A and the upper end of the lower transverse cut line 64B with equal amounts of material retained to both sides of line 66. This avoids a continuous concave recess, as at 68, in the outer edge of one or more adjacent blanks 56 which would occur were an attempt made to extend the convex outer edge of one or each blank for the full edge length, as suggested by the phantom line showing in FIG. 6. Elimination of the recess 68, if following the teaching in the prior art, would require separate or dual cut lines as discussed above and as is clearly contrary to the goals of the present invention. Accordingly, it is a significant feature of the invention that each longitudinal cut line 52 include, as noted in FIG. 6, the linear extents 66. This linear extent 66 will occur at each of the opposed outer portions of the outer longitudinal edge 60 of each blank. So formed, the recess or recesses 68 which would be formed in one or both of the adjacent outer edge corners 61 were the arcs continued to the extreme ends are avoided, and maximum material is provided to both of the commonly formed longitudinal edge end portions. It will be recognized that each of the linear extents 66 is equal in length to the longitudinal distance the corresponding end portion of the outer edge 60 extends beyond the corresponding end of the inner edge 62 of the same blank 56.

In forming the inner longitudinal edge 62 of the blank 56 on an equal radius with the outer longitudinal edge 60, it has been found that, particularly with regard to smaller capacity cups, for example 16 ounces or less, slightly less material is available at the opposed inner edge corner portions 63, thus giving rise to potential difficulties in crimping this inner edge to the cup bottom panel. Accordingly, and noting FIG. 7, approximately 1/16 inch, as indicated at 70, is provided at the inner corner defined by each inner edge line 62, in effect extending the corresponding transverse end cut line 64A by that amount and defining a new inner edge corner 74 to which the linear extent 66 is aligned. The phantom line showing in FIG. 7 duplicates the position of the linear extent 66 in FIG. 6 for purposes of comparison. A second straight line or linear extent 76 extends from the inner corner to the arced central portion of the longitudinal inner edge 62 spaced inwardly from the transverse edge 64A a distance generally one half the length of the first linear extent 66. So configured, sufficient additional material is provided along the longitudinal inner edge of the cup blank 56 to make up for the slight loss of material resulting from the use of the common radii, and to insure proper accommodation of the blank by automated cup-forming equipment and the presence of sufficient material to insure a proper crimp forming of the bottom portion of the cup.

As will be recognized, the linear extent 76 will appear not only at the opposed end portions of the inner longitudinal edge 62, but also along the outer longitudinal edge 60 inward of the corresponding first extents 66 as will be possibly best appreciated from the slightly exaggerated z showing in FIG. 8. Imaginary vertical lines 77 in FIG. 8 illustrate the positional relationship between the linear extents in the opposed outer and inner edges 60 and 62.

While not limited thereto, as one example of the orientation and length of the linear or straight line extents 66 and 76, in a 16 ounce cup the linear extent 66 will extend at approximately 13° to the horizontal or an imaginary base line 79 between the outer corners, with the second linear extent 76 extending at approximately 15.24° to the base line 79.

As suggested, and in comparison with the cup of FIG. 3, the linear extents 66 may result in slightly less material within the curled upper lip. However, inasmuch as the lip 24 of the standard cup actually includes excess material beyond that needed for strength or stability, the reduced material of the lip does not affect the integrity of the cup.

With regard to the bottom end of the cup 80 as illustrated in FIG. 9, the inwardly turned inner edge portion 84, while slightly less, particularly at the overlapped extremities, thereof, is more than sufficient to engage and retain the bottom panel 86. This is particularly the case in those blanks wherein the second linear extent 76 provides, as indicated at 88, approximately 1/16 inch additional material. The phantom line showing in FIG. 9, for purposes of comparison, indicates the position of the inner edge 62 without the linear extent 76.

As an example of the savings in material, for 16 ounce cups above described, a layout of four rows of four blanks each with the standard or conventional cup blank requires over 65 square inches more than a layout of a similar number of cup blanks in accord with the present invention. This is a material savings of approximately 5.5%. In view of the vast number of such cups produced, the actual monetary saving in material alone is substantial.

It is to be appreciated that while in the preferred embodiments the linear extents are straight lines, variations are possible wherein a single cut line is provided with equally positioned equal amounts of material retained to each side of a center line. For example, the linear extent can be sinuous with equal lobes to each side thereof.

The foregoing is considered illustrate of the principles of the invention. While dimensional variations will occur, particularly with changes in cup sizes, in each instance a cup constructed in accord with the invention will be of equal volume and of substantially the same strength and appearance as a conventionally formed cup of the same size, notwithstanding the substantial economies achieved.

We claim:

1. A waste reduction blank for use in the formation of a tapered cup; said blank being of generally arcuate configuration having opposed outer and inner longitudinal edges, each of said longitudinal edges having an arcuate central portion, each of the central portions being on a radius equal to the radius of the other central portion, said outer edge being longer than said inner edge and having opposed end portions extending from said outer edge central portion and terminating longitudinally beyond said inner edge, said blank including opposed side edges extending from and defining outer corners with said outer longitudinal edge to and defining inner corners with said inner longitudinal edge, said side edges converging laterally inward toward each other between said outer longitudinal edge and said inner longitudinal edge, said corners being at equal predetermined distances longitudinally beyond said inner corners, said end portions of said outer edge being along linear extents and extending longitudinally inward of said outer corners for at least said predetermined distances.

2. The blank of claim 1, wherein each end portion includes two linear extents, a first linear extent extending longitudinally inward from the corresponding outer corner and a equal length with the corresponding predetermined distance, and a second linear extent extending longitudinally inward of said first linear extent and terminating at said arcuate central portion of said outer longitudinal edge.

3. The blank of claim 2 wherein each of said second linear extents is of a lesser length than the corresponding first linear extent.

4. The blank of claim 3 wherein said inner longitudinal edge includes a pair of linear extents respectively extending longitudinally inward from said opposed inner corners of the blank.

5. The blank of claim 4 wherein said linear extents of said inner linear edge are of equal length with said second longitudinal extents of said outer linear edge.

6. The blank of claim 5 including an imaginary base line defined between said outer corners, said first linear extents of said outer edge extending at an acute angle to said base line, said second linear extents of said outer edge extending at an acute angle to said base line greater than the angle of said first linear extents.

7. The blank of claim 6 wherein said linear extents of said inner longitudinal edge extend at the angle of said second linear extents of said outer longitudinal edge.

8. The blank of claim 1 wherein said inner longitudinal edge is longitudinally coextensive with said arcuate central portion of said outer longitudinal edge.

9. The blank of claim 8 wherein said inner longitudinal edge follows an arc for the full length thereof formed on a single radius.

10. A waste reduction cutting layout for the cutting of blanks from a sheet of flexible material; said cutting layout including a plurality of laterally spaced, longitudinally extending, sinuous longitudinal lines having alternate equal and oppositely extending substantially arcuate portions, said longitudinal lines being parallel and defining rows the height of which define the height of the cups to be formed, adjacent ones of said rows being defined by a single one of said longitudinal lines therebetween, and spaced transverse lines extending across each row between adjacent longitudinal lines, said transverse lines across each row being alternately oppositely inclined and intersecting each longitudinal line of the adjacent pair of lines at points generally between adjacent oppositely extending substantially arcuate portions of these longitudinal lines, said alternately oppositely inclined transverse lines forming equally and alternately arced blank-defining segments along each of said rows, the segments of adjacent rows being transversely aligned with said transverse lines of each row having corresponding transverse lines parallel thereto in adjacent rows, adjacent ones of said corresponding transverse lines in adjacent rows meeting said longitudinal line therebetween at longitudinally offset meeting points and defining a line length extent therebetween.

11. The layout of claim 10 wherein each said line length extent is linear.

12. The layout of claim 11 wherein adjacent pairs of said transverse lines across each of said rows alternately converge toward the opposed longitudinal lines defining that row.

13. The layout of claim 12 wherein each longitudinal line, at the meeting point with each of a pair of adjacent converging transverse lines, includes a second linear line extent extending longitudinally inward of the converging transverse lines toward each other.

* * * * *

UNITED STATES PATENT AND TRADEMARK OFFICE

CERTIFICATE OF CORRECTION

PATENT NO. : 5,229,182
DATED : July 20, 1993
INVENTOR(S) : Larry Eisman, et. al.

It is certified that error appears in the above-indentified patent and that said Letters Patent is hereby corrected as shown below:

Column 6, Claim 2, line 4, "a" should be --of--.
Column 6, Claim 5, line 2, "linear" should be --longitudinal--.
Column 7, Claim 10, line 2, before "blanks" insert --cup--.
Column 8, Claim 13, line 4, before "extent" insert --length--.

Signed and Sealed this
Fifth Day of April, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,229,182
DATED : July 20, 1993
INVENTOR(S) : Larry Eisman et al

It is certified that error appears in the above-indentified patent and that said Letters Patent is hereby corrected as shown below:

Col. 6, claim 5, line 3, "longitudinal" should read --linear--.
line 3, "linear" should be --longitudinal--.

Signed and Sealed this
Fifth Day of July, 1994

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,229,182

DATED : July 20, 1993

INVENTOR(S) : Larry EISMAN; Gina POLSIN; Frank SABO

It is certified that error appears in the above-indentified patent and that said Letters Patent is hereby corrected as shown below:

Column 6, claim 1, line 38 , before "corners", insert --outer--.

Signed and Sealed this

Ninth Day of June, 1998

*Attest:*

*Attesting Officer*

BRUCE LEHMAN

*Commissioner of Patents and Trademarks*